United States Patent [19]

Cash

[11] Patent Number: 4,551,200

[45] Date of Patent: Nov. 5, 1985

[54] PAPER SIZING COMPOSITION AND METHOD

[75] Inventor: Gordon G. Cash, Asheville, N.C.

[73] Assignee: Olin Corporation, Pisgah Forest, N.C.

[21] Appl. No.: 629,517

[22] Filed: Jul. 10, 1984

[51] Int. Cl.[4] ..... D21H 1/34

[52] U.S. Cl. ..... 162/135; 162/136; 162/158; 162/183; 427/386; 427/391

[58] Field of Search ..... 162/158, 135, 157.6, 162/136, 164.3, 179, 183; 8/116 R, DIG. 8; 427/386, 391

[56] References Cited

U.S. PATENT DOCUMENTS

| | | | |
|---|---|---|---|
| 2,252,039 | 8/1941 | Schirm | 8/DIG. 8 |
| 3,077,420 | 2/1963 | Kenaga | 8/DIG. 8 |
| 3,158,581 | 11/1964 | Vandenberg | 162/164.3 |
| 3,278,561 | 10/1966 | Gaertner | 260/348 |
| 3,291,679 | 12/1966 | O'Brien | 162/164 |
| 3,391,018 | 7/1968 | Gaertner | 117/135.5 |
| 3,431,143 | 3/1969 | Johnson et al. | 117/155 |
| 3,459,715 | 8/1969 | Gaertner | 260/78.5 |
| 3,562,102 | 2/1971 | Gaertner | 162/168 |
| 4,200,489 | 4/1980 | Tlach et al. | 162/164 |
| 4,299,654 | 11/1981 | Tlach et al. | 162/164 |

FOREIGN PATENT DOCUMENTS

| | | | |
|---|---|---|---|
| 828044 | 11/1969 | Canada | 8/DIG. 8 |
| 1340779 | 12/1961 | France | 8/DIG. 8 |

OTHER PUBLICATIONS

Soignet et al., Journal of Applied Polymer Science, vol. 11, pp. 1155–1172 (1967).

McKelvey et al., Textile Chemist and Colorist, vol. 4, pp. 35–38 (1972).

Berni et al., Textile Research Journal, pp. 576–586 (Aug. 1960).

*Primary Examiner*—Peter Chin

*Attorney, Agent, or Firm*—Kerkam, Stowell, Kondracki and Clarke

[57] ABSTRACT

A method for sizing cellulosic fiber containing paper with a sizing agent having the formula:

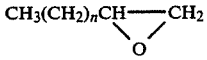

wherein n is an integer from 12 to 24.

The sizing agent is reacted with the paper at a pH of from about 11 to about 14 in the presence of tetrabutylammonium hydroxide.

18 Claims, No Drawings

PAPER SIZING COMPOSITION AND METHOD

BACKGROUND OF INVENTION

1. Field of Invention

The present invention relates to a method and composition for sizing cellulosic fibers or cellulosic fiber-containing material and cellulosic fiber-containing substrates sized thereby.

2. Prior Art

Numerous compositions and methods have been suggested heretofore for sizing paper, i.e., rendering the paper more resistant to penetration by liquids. Materials such as resins, various hydrocarbon and natural waxes, starches, glues, casein, asphalt emulsions, synthetic resins and cellulose derivatives have been employed as sizing agents. See, e.g., U.S. Pat. Nos. 3,084,093; 3,084,092; 2,995,483; 2,964,445; 2,941,919, 2,903,391; 2,872,315; 2,830,916; 2,764,483; 2,684,300, etc.

Typically, such derivatives are added directly to the paper making stock as "beater additives" and precipitated on the paper as it is formed to yield "internal" or "engine" sizing. Alternatively, the paper sheet may be passed, after formation, through a size solution, or over a roll wetted with the size solution to produce "tub-sized" or "surface-sized" paper sheets.

Reagents which react with the cellulose content of paper through a functional group have also been utilized as sizing agents. For such procedures to be successful, however, it is necessary that the reagent have hydrophobic characteristics, i.e., resist the penetration of aqueous liquids into cellulosic fiber containing materials with which it is reacted. For example, in copending application Ser. No. 629,516, filed July 10, 1984, there is disclosed a method for sizing cellulosic fiber containing materials with certain long chain alkyl substituted sulfonates which react with the cellulose. The long chain alkyl group imparts a sufficient degree of hydrophobicity to the reagent to enable its use as a sizing agent.

Attempts have been made to react cellulose fibers with epoxides with varying degrees of success.

British Pat. No. 892,361 discloses that latexes of certain epoxidized polymers of conjugated dienes are useful as paper sizing agents.

U.S. Pat. Nos. 3,278,561 and 3,391,018 relate to the use of certain hydrophobic diglycidylamines as paper sizing reagents.

U.S. Pat. Nos. 3,459,715 and 3,562,102 disclose the use of mixed glycidyl esters of various compounds as sizing agents for paper.

U.S. Pat. No. 3,431,143 relates to the use of epoxy silicones to impart water penetration resistance to paper.

Berni et al (Textile Research Journal, pp. 576–286, August, 1960) disclose the utilization of fluorocarbon epoxides to react with cellulose containing materials.

U.S. Pat. No. 3,291,679 discloses that reaction products of polymeric olefin-maleic imide-amines and epihalohydrin are useful paper sizing agents.

U.S. Pat. Nos. 4,700,489 and 4,299,654 relate to the use of epoxide-amide-polyimides as paper sizing agents.

The starting materials for the preparation of these epoxy group containing reagents are relatively expensive, however, and the degree of hydrophobicity imparted to paper thereby is not sufficient for many purposes.

Inexpensive long chain alkyl epoxides are attractive candidates as potential sizing agents for cellulosic fiber containing materials; however, previous attempts to achieve reaction between such epoxides and cellulose have been largely unsuccessful. Thus, McKelvey et al [Textile Chemist and Colorist, Vol. 4, pp. 35–38 (1972)] disclose that 1,2-olefin epoxides react with cellulose but that reactivity with cotton cellulose vanishes where the epoxide contains a chain longer than 5 or 6 carbon atoms. Soignet et al [J. of Applied Polymer Science, Vol. 11, pp. 1155–72 (1967)] indicate that attempts to react $C_{11}$–$C_{14}$ epoxides with cotton cellulose were unsuccessful.

It is an object of the present invention to provide a composition and method for sizing cellulosic fiber containing materials with hydrophobic, long chain alkyl epoxides.

Other aspects, objects and advantages of this invention will be apparent from a consideration of the accompanying disclosure and the appended claims.

SUMMARY OF THE INVENTION

In accordance with this invention there is provided a method for sizing cellulosic fibers or cellulosic fiber-containing material comprising reacting the fibers or fiber-containing material with a sizing agent having the formula:

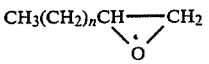

or a hydrophobic substituted derivative thereof wherein n is an integer from 12 to 24.

In accordance with another aspect of this invention there is provided a composition for sizing cellulose fibers or cellulosic fiber-containing materials comprising an organic solvent solution of a sizing agent of the above formula.

In accordance with still a further aspect of this invention there is provided cellulose fibers or cellulosic fiber-containing materials sized by reaction with an epoxide of the above formula.

DETAILED DESCRIPTION OF THE INVENTION

The present invention is predicated on the discovery that a satisfactory reaction between long chain alkyl or substituted alkyl epoxides and cellulose fibers can be achieved under certain conditions and that the reaction product is highly hydrophobic, i.e., resistant to penetration by aqueous liquids. The method and composition, therefore, are useful for sizing any cellulosic fiber-containing material such as paper, cotton textiles, or to increase the hydrophobic character of any other cellulosic material having reactive OH groups.

It is critical to the success of the invention that the reaction between the cellulose fibers and the epoxide be conducted under certain alkaline conditions, namely at a pH of about 11 to about 14. Specifically, the reaction is promoted by the quaternary amine salt tetrabutylammonium hydroxide. Sodium hydroxide is much less effective, and benzyltrimethylammonium hydroxide is ineffective. Thus, in the reaction of the invention, pH as well as the identity of the base used is of critical importance.

It is also necessary to conduct the reaction between the cellulose fibers and the epoxide at an elevated temperature, i.e., at from about 100° to about 125° C.

Any hydrophobic substituted derivatives of the above-described alkyl epoxides may also be utilized in the practice of the invention, e.g., alkyl and aralkyl substituents such that the molecule contains 12 to about 24 carbon atoms.

The epoxides of the above formula do not readily lend themselves to "internal" or "engine" paper sizing procedures inasmuch as the basic conditions required for reaction between the cellulose fibers and the epoxy group generally far exceed those normally found in the head box or other stage of the paper making process during which additives are added to the slurry.

Therefore, when sizing paper according to the method of the invention, it is preferred to "surface size" the paper. Any conventional surface sizing techniques may be employed to carry out the invention. Thus, the paper sheet may be passed through a tub of a solution of the epoxide or passed over a roller or other applicator in contact with a solution of the epoxide. Those skilled in the art, having been exposed to the principles of the invention, will be aware of suitable techniques for achieving the sizing reaction without the exercise of undue experimentation.

When sizing paper it is preferable to react the cellulosic fibers thereof with at least about a 4%, by weight-/volume solution, of the epoxide. Amounts less than 4% will not enhance the hydrophobicity of the cellulosic fibers to any significant degree. Generally, amounts greater than about 10% by weight/volume will not result in any added degree of hydrophobicity.

The preferred method of carrying out the invention is to pre-wet the paper substrate with an aqueous solution of the base and then wet the substrate with a solution of the epoxide for a time sufficient to allow the reaction to go to completion. Preferably, the paper, pre-wetted with basic solution, is allowed to dry before wetting with the epoxide solution. Drying the pre-wetted paper may be accelerated by heating to a temperature in the range of from about 40° C. to about 75° C.

The preferred epoxy is hexadecyloxirane, i.e., the compound of the above formula wherein n is 15.

The epoxide is preferably dissolved in an organic solvent for reaction with the cellulosic fibers. Any suitable organic solvent for the epoxide may be employed which is inert with respect to the cellulosic fiber containing material. Suitable such solvents include dimethylformamide, sulfolane, etc.

The preferred solvent is dimethylformamide (DMF). Generally, the solution should contain from about 4% to about 15%, preferably from about 5% to about 10% weight/volume of epoxide, in order to enable the reaction with the cellulose fibers to proceed efficiently.

The reaction between the cellulosic fibers and the epoxide sizing agent is generally completed in from about 0.5 to about 2 min. when conducted at the above temperatures.

Preferably, the cellulosic fiber containing material is washed with a suitable liquid, e.g., water, following completion of the reaction to remove excess base, epoxide, solvent, etc.

Following completion of the reaction between the cellulosic fibers and epoxide, the cellulosic fiber-containing material is dried to produce the sized product. Optimal drying may be accomplished by heating the material at a temperature of from about 40° C. to about 75° C.

The invention is illustrated by the following non-limiting examples.

EXAMPLE 1

Sheets of paper, basis weight 25 g/m$^2$ and Greiner porosity 45 ml/15 sec. containing 25% $CaCO_3$ filler were contacted with a 5% weight/volume aqueous solution of tetrabutylammonium hydroxide until the papers were thoroughly wetted. The papers were heated at 75° C. until visibly dry. The above procedure was repeated using 5% and 10% (weight) solutions of hexadecyloxirane in DMF at 95° C. until the papers were again thoroughly wetted. The wetted papers were dried at 120° C. at which time the reaction between epoxide and cellulose were complete. The papers were washed twice with water and briefly dried at 50° C.

The effectiveness of the sizing reaction was determined with a Hercules Sizing Tester, Model KA. This instrument measures, by reflectance, the speed of penetration of an aqueous ink through the sheet.

The sized papers exhibited ink penetration times greater than 500 seconds for those treated with 10% solutions of the epoxide and 107 seconds for those treated with 5% solutions. The untreated paper exhibited an ink penetration time of 0.5 second.

Those skilled in the art, having been exposed to the principles of the invention, will be able to determine optimum reaction parameters, depending upon the particular cellulosic fiber-containing material to be sized and the epoxide selected without the exercise of undue experimentation.

The epoxide utilized as sizing agents in the method, composition and product of the invention may be prepared by oxidizing the appropriate terminal olefin with m-chloroperbenzoic acid, a reagent first described for this purpose by Schwartz et al [J. Org. Chem., Vol. 29, pp. 1976 ff. (1964)].

I claim:

1. A method for sizing cellulosic fiber-containing paper comprising reacting said paper at a pH of from about 11 to about 14 in the presence of tetrabutylammonium hydroxide with an amount of a sizing agent at a temperature of at least about 100° C. and for a time sufficient to impart hydrophobicity to said paper, said tetrabutylammonium hydroxide being present in an amount sufficient to promote said reaction, said sizing agent having the formula:

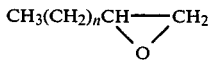

or a hydrophobic substituted derivative thereof wherein n is an integer from 12 to 24.

2. The method of claim 1 wherein the cellulose fibers of said paper are reacted with at least about a 4% weight/volume solution of said sizing agent.

3. The method of claim 2 wherein said paper is wetted with a solution of said sizing agent for a time sufficient to allow said reaction to occur.

4. The method of claim 3 comprising wetting said paper with an aqueous solution of tetrabutylammonium hydroxide prior to wetting thereof with said solution of sizing agent.

5. The method of claim 4 wherein said paper wetted with said aqueous solution of tetrabutylammonium hydroxide is allowed to dry prior to wetting thereof with said solution of sizing agent.

6. The method of claim 5 wherein said paper wetted with said aqueous solution of tetrabutylammonium hydroxide is dried by heating.

7. The method of claim 6 wherein said drying by heating is carried out at a temperature of from about 40° to about 75° C.

8. The method of claim 1 wherein n is 15.

9. The method of claim 3 wherein said solution of sizing agent comprises a solution of the sizing agent in an organic solvent inert with respect to said paper.

10. The method of claim 9 wherein said organic solvent is selected from the group consisting of dimethylformamide and solfolane.

11. The method of claim 9 wherein said organic solvent is dimethylformamide.

12. The method of claim 3 wherein said paper is wetted with said solution of sizing agent at a temperature from about 90° C. to about 120° C.

13. The method of claim 9 wherein n is 16, said solvent is dimethylformamide and said solution contains from about 4% to about 15% weight/volume of said sizing agent.

14. The method of claim 9 wherein said paper is dried by heating after reaction of said sizing agent with said cellulose.

15. The method of claim 14 wherein said drying by heating is carried out at a temperature of from about 40° C. to about 75° C.

16. The method of claim 3 wherein said sizing agent is allowed to react with the cellulose in said paper for a time of from about 0.5 to about 2.

17. The method of claim 3 wherein, following said reaction, said paper is washed with water to remove excess base, solvents and sizing agent and dried.

18. The sized cellulosic fiber-containing paper produced according to the method of claim 1.

* * * * *